United States Patent [19]

Ohmura et al.

[11] Patent Number: 4,941,022

[45] Date of Patent: Jul. 10, 1990

[54] TONER RECOVERY DEVICE

[75] Inventors: Atsuo Ohmura; Jun-ichi Koiso; Kohji Ishii; Mitsugu Nemoto, all of Hachioji, Japan

[73] Assignee: Konica Corporation, Tokyo, Japan

[21] Appl. No.: 432,000

[22] Filed: Nov. 6, 1989

[30] Foreign Application Priority Data

Nov. 11, 1988 [JP] Japan ..... 63-284971
Dec. 13, 1988 [JP] Japan ..... 63-314254
Dec. 28, 1988 [JP] Japan ..... 63-334544

[51] Int. Cl.[5] ..... G03G 21/00

[52] U.S. Cl. ..... 355/298; 355/260; 222/DIG. 1

[58] Field of Search ..... 355/260, 298, 215; 222/DIG. 1, 514

[56] References Cited

U.S. PATENT DOCUMENTS 4,500,196 2/1985 Shimura ..... 355/298 X
4,630,653 12/1986 Kan ..... 355/298 X
4,819,578 4/1989 Koiso et al. ..... 355/298 X

FOREIGN PATENT DOCUMENTS 0137978 8/1984 Japan ..... 355/298
0134273 7/1985 Japan ..... 355/298
0114270 5/1986 Japan ..... 355/298

*Primary Examiner*—A. C. Prescott
*Assistant Examiner*—William J. Royer
*Attorney, Agent, or Firm*—Jordan B. Bierman

[57] ABSTRACT

The invention provides a toner recovery device for collecting toner from a cleaning device into a recovery toner container. The device includes a toner conveyance, an operating lever and a shutter. The tone conveyance has a conveyance pipe whose base end portion is rotatably connected to the cleaning device and tip end portion with an outlet opening is detachably coupled to an inlet opening of the recovery toner container so that the tip end portion is pivotted around the base end portion so as to take the coupled position and the detached position. The operating lever is linked to the conveying pipe for pivotting the tip end portion between the coupled position and the detached position. The shutter is adapted to move on the conveying pipe interlockingly with the movement of the operating lever so that the shutter closes the outlet opening of the conveying pipe on the detached position and opens the outlet opening on the coupled position.

6 Claims, 8 Drawing Sheets

TONER RECOVERY DEVICE

BACKGROUND OF THE INVENTION

The present invention relates to the improvement of a toner recovery device for recovering the toner scraped off by the cleaning device designed to remove the toner remained on the image forming body after the transfer onto the recording paper of the image obtained by visualizing with the toner the electrostatic latent image formed on the image forming body such as the photosensitive drum by the electrophotographic recording device or electrostatic recording device.

In the cases of the electrophotographic duplicating machine and the electrostatic recording machine utilizing the electrostatic latent image, the electrostatic latent image is formed on the photosensitive drum, and the electrostatic latent image is visualized with the toner development device so that the image formed with the toner is transferred and fixed onto the recording paper to obtain the desired recorded image.

In said cases, the residual electric charge on the photosensitive drum which has once been used for the transfer of the toner image is neutralized by the charge-removing electrode, and the residual toner on the photosensitive drum is scraped off by the cleaning device to be ready for forming the next electrostatic latent image thereon.

In the case of said development device, about 70% of the toner supplied from the toner supplier is consumed for visualizing the image, and the rest of 30% is removed from the surface of the photosensitive drum by the cleaning device. Then, the used toner removed from the surface of the photosensitive drum is once collected into the toner collector in the duplicating machine and then carried into the collected toner container through the conveyance pipe.

Thus, in the conventional toner recovery device, recovered toner container is provided separately from the feed toner container. Thus, the recovered toner container is designed to be capable of directly connected to and disconnected from the stationary toner conveyance pipe communicating with the cleaning device. In this case, the toner conveyance pipe is provided with a shutter designed to operate simultaneously with the connecting and disconnecting actions of the conveyance pipe to prevent the toner from spilling from the outlet at the end of the pipe (Refer to Japanese Patent Publication Open to Public Inspection Nos. 134273/86, 6679/86 and 93480/86). In the case of the above-described conventional toner recovery device, however, the recovered toner container is separated from the feed toner container, and this caused the operator of the duplicating machine to tend to forget the change of the recovered toner container when changing the feed toner container. As a result, the recovered toner fills up the container until spilling from the container to contaminate around by the time of the next change of the feed toner container. Thus, recently the toner recovery device wherein the feed toner container and the recovered toner container are combined into a unit has been developed.

In the case of such a unitized toner recovery device, however, the location of the recovered toner container is limited due to the location of the feed toner container. As a result, the recovered toner container is required to be located above the development device, so that the cleaning device and recovered toner container need to be connected with a long toner conveyance pipe. Besides, the toner conveyance pipe is required to be removable to make easier the replacement of the recovered toner container, but there has been no appropriate device to prevent the toner from spilling outside from the outlet at the end of the pipe.

In consideration of said shortcoming of the conventional toner recovery device, it is the first object of the present invention to provide a toner recovery device of a simple construction characterized by that the outlet of the toner conveyance pipe can be closed when the pipe is brought to the point of disconnection to prevent the spill of the toner.

The relationship between the toner conveyance pipe and the recovered toner container in a conventional toner recovery is shown in FIG. 11(*a*) through (*d*) to clarify the problem of the conventional toner recovery device. FIG. 11(*a*) shows a conveyance pipe P passing vertically through the center of the top of a recovered toner container C so that the recovered toner T is accumulated into a conical shape in the recovered toner container C. FIG. 11(*b*) shows the case where the conveyance pipe P passes through the left side wall of the recovered toner container C so that the recovered toner is accumulated forming a slope. FIG. 11(*c*) and (*d*) show the cases where the conveyance pipe P is connected to an opening C′ provided at the top of the recovered toner container C so that the toner T conveyed by the conveyance pipe P is accumulated into an asymmetrical conical shape.

The cause for the toner to be accumulated in a conical shape or in a slope lies in the problem concerning the conveyance pipe P itself. More particularly, in the case of the conventional conveyance pipe P, a screw member S is passed longitudinally through inside of the pipe member so that the toner can be forced forward as the screw member turns to carry the toner into the recovered toner container C. In this mechanism, however, there is the possibility that the toner gradually deposits on the internal wall surface near the outlet of the conveyance pipe as the conveying force decreases until to block the smooth flow of the toner, which may end up with the break of the screw in the extreme case.

Because of the reasons discussed above, in either of the above-described cases, the packing capacity of the recovered toner container becomes unstable, thereby causing the toner to spill from the opening of the container before the container is filled up with the toner. Thus, in order to overcome such problems, the conventional toner recovery device is provided with a photoelectric detector to monitor the condition of the toner near the entrance of the recovered toner container so that some appropriate vibration can be given to the recovered toner container to level the surface of the toner when the toner is accumulated in conical shape or in an asymmetric conical shape.

In consideration of the above-described problem, the second object of the present invention is to provide a toner recovery device improved in the efficiency in conveying the toner through the conveyance pipe and the efficiency in carrying the toner into the recovered toner container.

SUMMARY OF THE INVENTION

In order to realize said first object of the present invention, the toner recovery device according to the present invention comprises a recovered toner container and a feed toner container, which are unitized, a toner conveyance pipe whose base end is oscillatably installed to a cleaning member whereas whose the other end with outlet is removably installed to the entrance to the recovered toner container, an interlocking device is linked to the toner conveyance pipe at about the middle of the longitudinal span of said toner conveyance pipe to oscillate said toner conveyance pipe up and down between the set position and shunting position thereof and a shutter interlocked with said interlocking device and installed displaceably on the toner conveyance pipe so that the outlet at the end of the toner conveyance pipe can be closed when the toner conveyance pipe is at its shunting position and said outlet can be opened with the toner conveyance pipe is at the set position.

In order to realize the second object of the present invention, the toner recovery device according to the present invention comprises a toner conveyance pipe to convey the toner from the toner collector of a cleaning device to a recovered toner container located near a toner feeder, a screw member to turn inside the conveyance pipe and a toner discharging impeller or a toner discharging spatula fixed to the front end of said screw member so as to be able turn together with the screw member, and also the toner recovery device according to the present invention is characterized by that the turning radius R of said impeller, the radius r of said screw member and the inside diameter D of said pipe member maintains the relationship of $$r \leqq R < D/2,$$

so that the toner deposited on the internal surface near the toner outlet of the toner conveyance pipe can be scrapped off efficiently to prevent the deposition of the toner near the outlet of the pipe, the blocking of the flow of the toner due to the deposition of the toner and the resulting damage to the screw.

Further, according to the art devised by the present inventor, in order to provide a toner conveyance device not only capable of preventing the poor rotation and break of the screw member but also capable of improving the efficiency of packing the toner into the recovered toner container, the screw member is installed in the toner conveyance pipe with the toner discharging outlet communicating with the toner recovery opening of the recovered toner container; an impeller member for discharging the toner through said toner discharging outlet is fixed to the tie end of said screw member; and the length of said impeller member is made longer than the length of the opening of said toner discharging outlet so that the impeller member will not come into contact with the discharging outlet when the screw member rotates.

DETAILED DESCRIPTION OF THE INVENTION

Hereafter, the content of the present invention will be explained referring to an embodiment of the present invention shown in the accompanying drawings.

Figure 1:
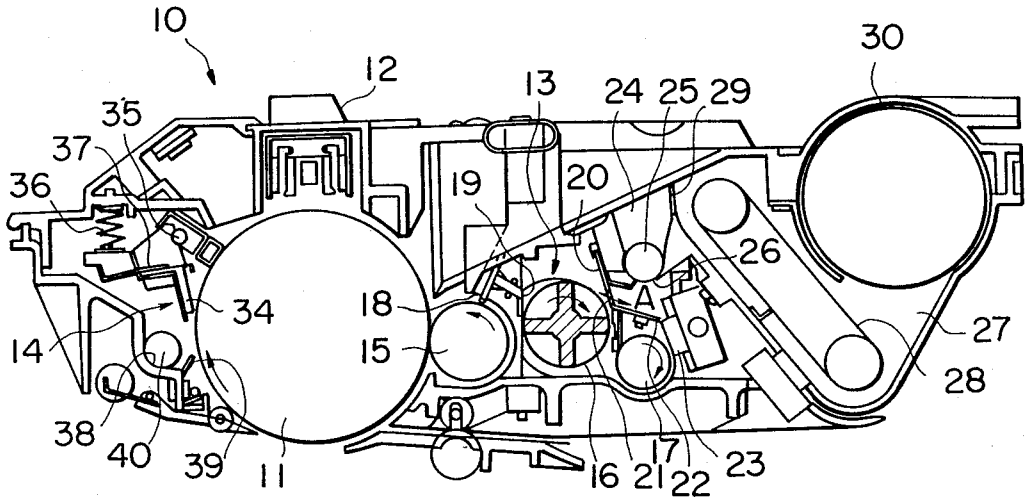
FIG. 1 is an outline drawing to show an example of the composition of the photosensitive drum and other components disposed around in the duplicating machine according to the present invention.
Figure 2:
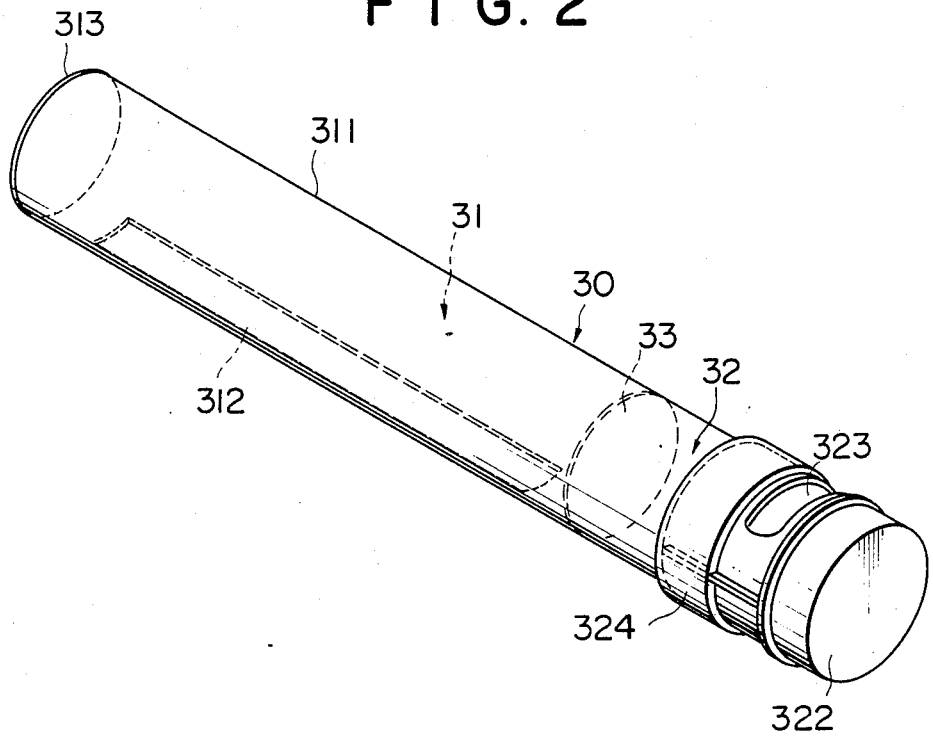
FIG. 2 shows an example of the construction of the toner cartridge which can replaceably be incorporated into the duplicating machine shown in FIG. 1.
Figure 3:
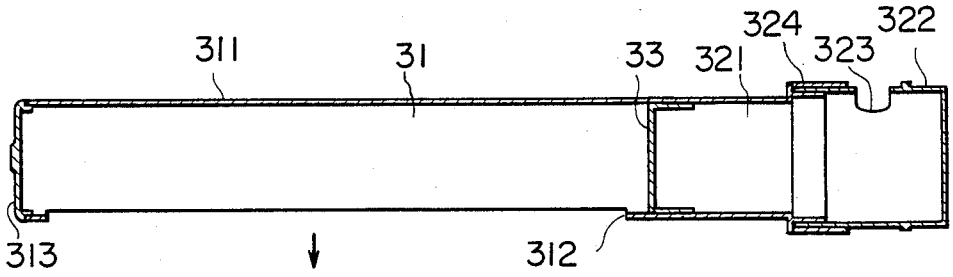
FIG. 3 is a longitudinal cross-sectional view of the toner cartridge according to the present invention.
Figure 4:
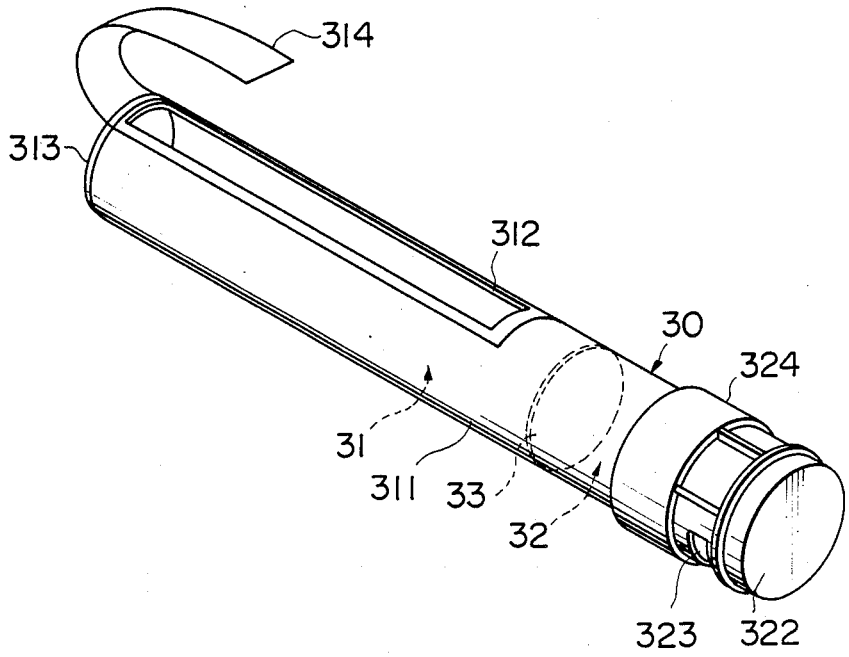
FIG. 4 is an oblique view of the toner cartridge with its toner feed opening facing upward.
Figure 5:
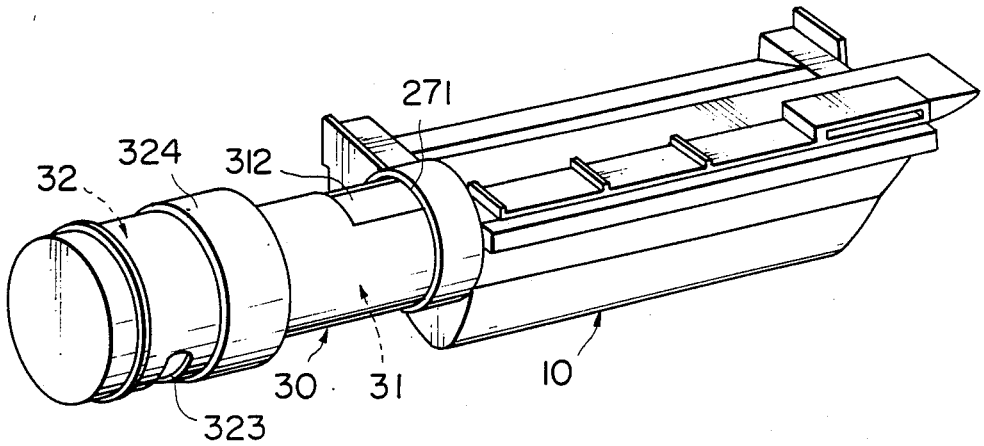
FIG. 5 is an oblique view showing the toner cartridge installed in position.

FIG. 1 is an outline drawing to show an example of the composition of the photosensitive drum and other components disposed around in the duplicating machine according to the present invention. FIG. 2 shows an example of the construction of the toner cartridge which can replaceably be incorporated into the duplicating machine shown in FIG. 1. FIG. 3 is a longitudinal cross-sectional view of the toner cartridge according to the present invention. FIG. 4 is an oblique view of the toner cartridge with its toner feed opening facing upward. FIG. 5 is an oblique view showing the toner cartridge installed in position. In these drawings the numeral 10 in FIG. 1 denotes a process cartridge. The process cartridge 10 itself consists of a publicly known photosensitive drum 11 surrounded by a charging device 12, a development device 13 and a cleaning device 14. A transfer device is located on the side of the duplicating machine body facing the bottom surface of the photosensitive drum 11, so that the transfer device is not shown in these drawings.

The development device 13 is provided with a development sleeve 15, a main stirring member 16 and an auxiliary stirring member 17 so that some portion of the developer taken up by the main stirring member 16 passes the gap formed by a doctor 18 and is deposited on the surface of the development device 15 to develop the electrostatic image formed on the surface of the photosensitive drum 11.

On the other hand, some portion of the developer is fed backward in order to be circulated to the auxiliary stirring member 17 passing the gap formed by a regulating member 19, the opening of a partition board 20 and an inclined board 22 in the direction indicated by an arrow A.

A toner concentration sensor 23 to detect the magnetic permeability is installed on the surface of the flow passage of the developing agent, which flows in the direction indicated by an arrow A passing an opening 21, so that the control signal corresponding to the detected value of the magnetic permeability can be outputted to the drive source (not shown) for the feed roller 25, which will be described later.

More particularly, when the drive signal or the stop signal from said sensor 23 is outputted to the drive source of the feed roller 25 installed in a toner feed chamber 24, the feed roller 25 rotates to cause the toner in the toner feed chamber 24 to be dropped onto the development member 13 through the gap formed by a mouth member 26 of the open groove so as to adjust the concentration of the toner to the specified level.

The numeral 27 denotes a toner storage room, and 28 a ladder chain installed in the toner storage room to be used for feeding the toner from the toner storage room 27 into the toner feed chamber 24 through a window 29.

In order to supply the fresh toner into the toner storage room 27, a toner cartridge 30 having the construction as that shown in FIGS. 2 through 4. Said toner cartridge is, for example, composed of a cylindrical container, which is divided into a feed toner container 31 and a cylindrical recovered toner container 32 by the internal partition board as illustrated in FIGS. 2 through 4, and the cartridge is designed to be loaded in a loader 271 provided on the toner storage room 27 of the process cartridge 10 on a condition where the feed toner container 31 is brought to the front side as illustrated in FIG. 5.

Said feed toner container 31 is sealed with a cap member 313 at the left end thereof, and a rectangular feed opening 312 is provided in the side wall along the longitudinal direction thereof. Said feed opening 312 is designed to be sealed with a flexible sealing member 314 after the feed toner is stored in the cylindrical body 311 as illustrated in FIG. 4.

On the other hand, the recovered toner container is formed so that the inside of which is divided to provide two separate spaces constituting the first cylindrical body 321 located near said partition board 33 and the second cylindrical body 322 located near the outside (upper right side in the drawing).

An arc-shaped toner recovery opening 323 formed by cutting the wall of the second cylindrical body along the circumferential direction thereof, and said toner recovery opening is provided with a shutter 324 which is slidable along the axial direction of the recovered toner container 32 so that the toner recovery opening can be closed with said shutter 324 while the recovered toner container 32 is not in use.

Said toner recovery opening 323, however, is disposed to be the opposite side (by 180° degree) of said feed opening 312 in order to permit the toner cartridge 30 to be loaded in and unloaded from said loading device 271.

More particularly, when loading the toner cartridge 30, the flexible sealing member 314 is peeled off before the toner cartridge is loaded into the loading device 271. In this case, the toner in the feed toner container 31 can be prevented from spilling from the feed opening 312 by bringing said feed opening 312 to face upward when loading the toner cartridge (Refer to FIG. 5).

Furthermore, when the toner cartridge 30 is turned by 180° after being loaded, the feed opening 312 is brought to face the straight downward to cause the toner in the feed toner container 31 to drop into the storage room 27 due to the gravity, and simultaneously the recovery opening 323 on the recovered toner container 32 is brought to the position ready for accepting the recovered toner at the time of the recovery of the toner (Refer to FIG. 3).

The cleaning device 14 is provided with a cleaning blade 34, which is installed so as to be pressed against the surface of the photosensitive drum 11 in order to scrape off the toner remaining on the surface of the photosensitive drum 11 after transfer of the toner image.

Said cleaning blade 34 is installed on the front edge of the supporting frame 37 whereon the counterclockwise turning force is acting due to the force of the compression spring acting around a shaft 35.

The numeral 38 denotes a groove for receiving the toner recovered by being scraped off with the cleaning blade 34. The numeral 39 denotes a toner guide plate provided between the receiving groove 38 and the photosensitive drum 11. The numeral 40 denotes a toner discharging screw installed in the toner receiving groove 38.

Figure 6:
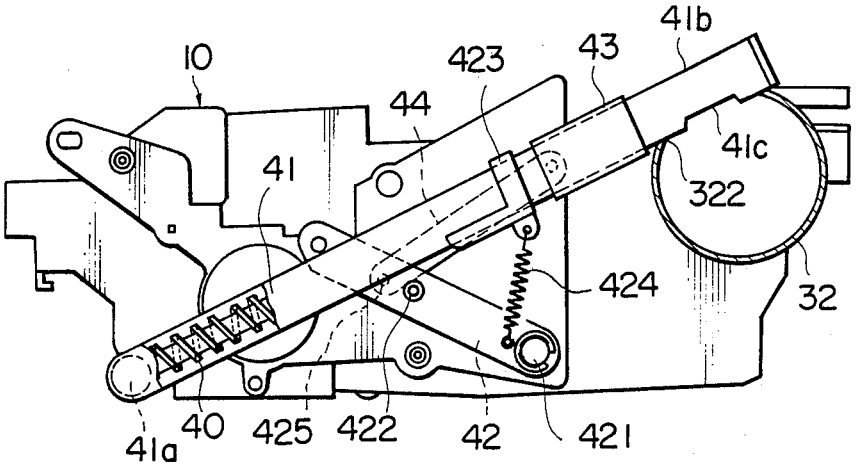
FIG. 6 is a side view showing the toner conveyance pipe set to its operating position and connected to the recovered toner container.
Figure 7:
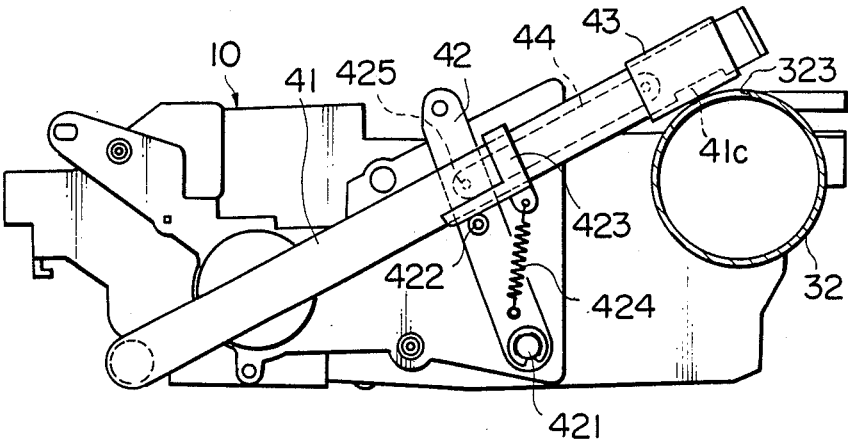
FIG. 7 is a side view showing the toner conveyance pipe displaced to its shunting position together with the toner conveyance pipe and the recovered toner container which are disconnected from each other.
Figure 8:
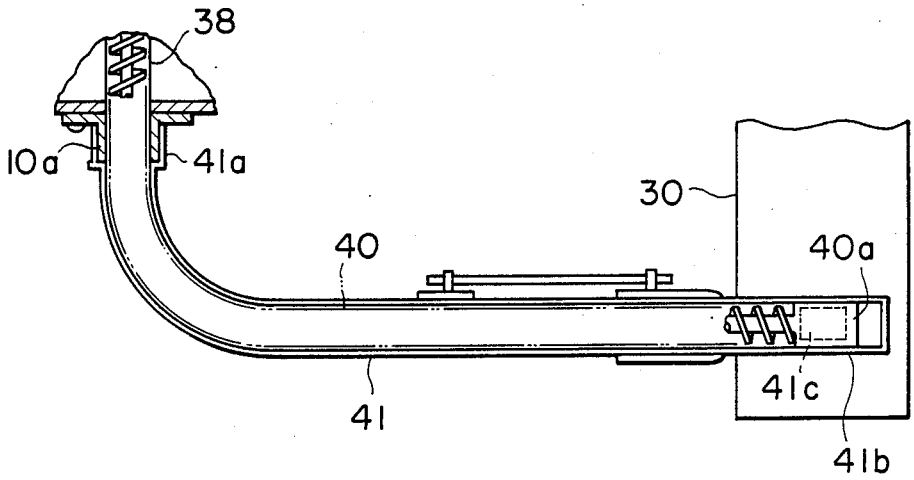
FIG. 8 is a plan showing the toner conveyance pipe communicating with the toner collecting part of the cleaning device located near the photosensitive drum.

The toner discharging screw 40 is, for example, formed a long coil-spring-like member as is illustrated in FIGS. 6 through 8, and a half of which is disposed almost straight along the toner receiving groove 38, whereas the other half of which passes through the projected wall **10*a* of the cleaning member 14 belonging to the process cartridge 10, enters into the toner conveyance pipe 41, changes its direction almost at a right angle near said projected wall 10*a* and further passes longitudinally in the toner conveyance pipe until reaching the front end 41*b*** thereof.

A toner discharging impeller **40*a* having the shape almost resembling that of a table tennis racket is installed on the front end of the toner discharging screw 40 so as to be able to turn together with said toner discharging screw 40 as illustrated in FIG. 8**.

The construction and the shape of the impeller **40*a* and the relationship among the impeller 40*a*, toner discharging screw 40 and toner conveyance pipe 41** will be explained later.

On the other hand, the base end **41*a* of the toner conveyance pipe 41 is rotatably connected to the toner receiving groove 38 at said projected wall 10*a*, bent almost at a right angle to the axis of the toner receiving groove 38 at the base end 41*a*, passes the space provided outside the process cartridge 10 and provides a communication between the toner receiving groove 38 and the toner cartridge 30 loaded in the loading device 271 of the toner storage room 27**.

Thus, the tip end **41*b* of the toner conveyance pipe 41 oscillates (directing upward and downward) around the base end 41*a* with respect to the toner cartridge 30 as illustrated in FIGS. 6 and 7, so that the toner outlet 41*c* located under the front end 41*b* of said pipe 41 can be connected to and disconnected from the recovery opening 323 of the recovered toner container 32**.

Said toner discharging impeller **40*a*** is installed so as to satisfy the conditions described hereafter.

Figure 9A:
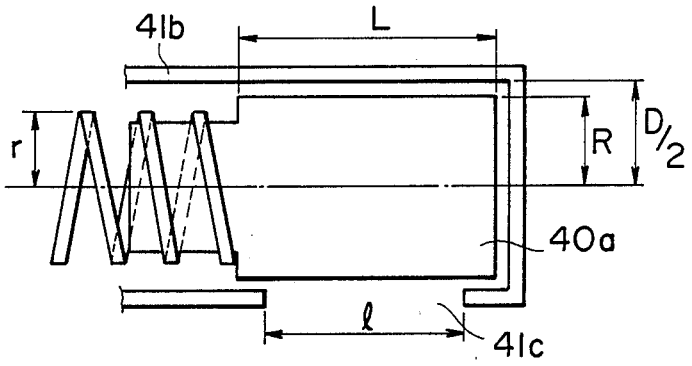
FIG. 9(*a*) through (*c*) are the explanatory drawings of the toner discharging impeller.
Figure 9B:
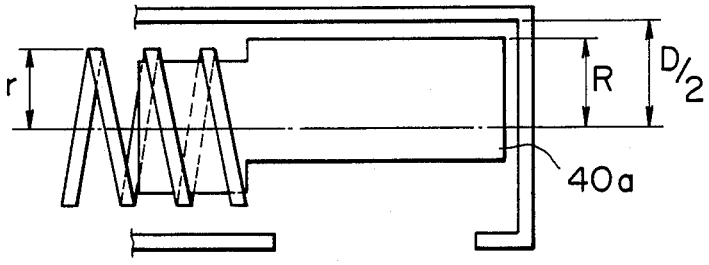
Figure 9C:
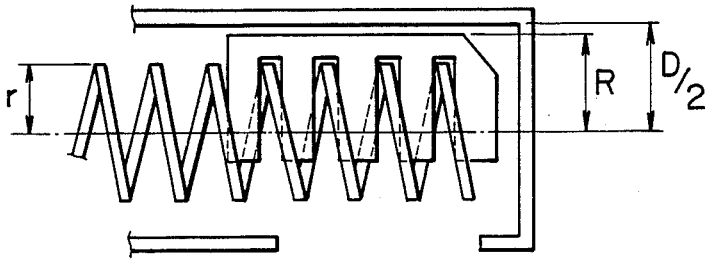

That is, as shown in FIG. 9(*a*) through (*c*), where the radius of the toner discharging screw 40 is r (mm); the inside diameter of the toner conveyance pipe 41, D (mm); and the turning radius of the impeller **40*a***, R (mm), the relationship of these values should be determined so as to be $$r \leqq R < D/2, \text{ and}$$

the amount of projection L (mm) should be determined so that $$L \geqq l$$

where the length of opening is l(mm).

In this case, the impeller **40*a*** either may be shaped symmetrical to the axis of the toner discharging screw 40 as illustrated in FIG. 9(*a*) or may be formed unilaterally to the axis of the toner discharging screw as illustrated in FIG. 9(*b*), or may be formed together with the front end of the toner discharging screw as illustrated in FIG. 9(*c*).

Figure 10A:
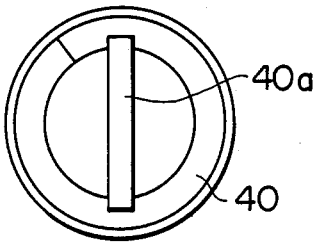
FIG. 10(*a*) and (*b*) explain the action of the toner discharging impeller respectively.
Figure 10B:
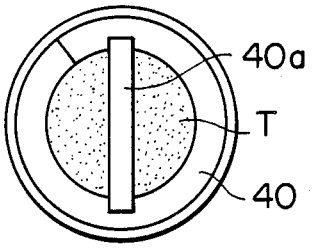
Figure 11A:
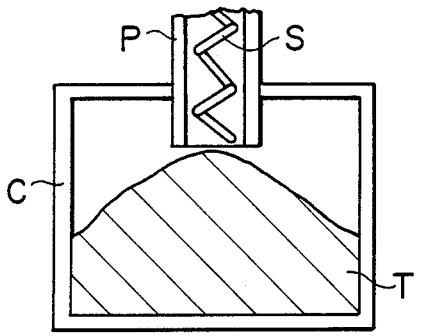
FIG. 11(*a*) through (*d*) explain the examples of the conventional toner recovery device.
Figure 11B:
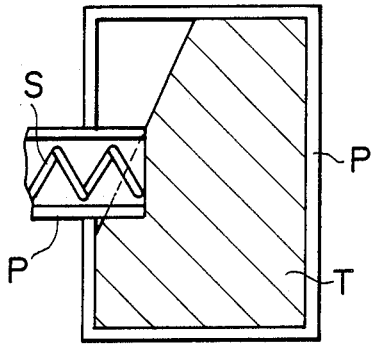
Figure 11C:
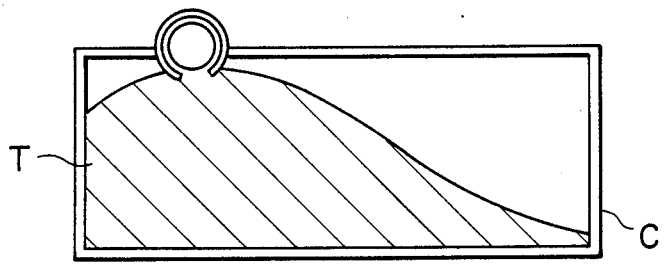
Figure 11D:
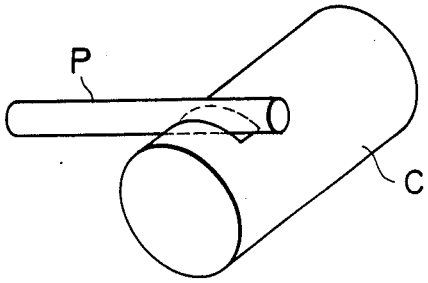

In any of the above cases, when the relationship between the radius r of the toner discharging screw 40 and the turning radius R of the impeller 40 does not meet the aforementioned requirement, that is, the relationship of $r \leqq R$ is not maintained as illustrated in FIG. 10(*a*), this causes the toner T to be deposited around the opening of the toner outlet 41*c* and the clogging of the pipe by the toner (indicated as the dotted area in the drawing), thereby eventually becoming the major cause of the poor rotation of the toner discharging screw 40.

When the clearance between the impeller 40*a* and the internal wall of the toner conveyance pipe 41 is unnecessarily large, the toner discharging screw 40 to rotate in the toner conveyance pipe is caused to have too large free space, which may lead to the break of the screw or the interference with the toner outlet 41*c*.

The length L (mm) of said impeller member 40*a* should be determined so that the relationship of $L>l$ can be maintained with the length l(mm) of the opening of the toner discharging outlet 41*c*. If said relationship is reversed or $L<l$, this will cause the impeller member 40*a* to contact with the discharging outlet 41*a* to cause the poor rotation thereof or the break of the screw. Thus, where said relationship is maintained as described first, the chances of the interference of the screw with the pipe will be eliminated, thereby improving the efficiency of packing the toner into the recovered toner container 32.

According to the present invention, the toner discharging screw 40, the impeller 40*a* and the toner conveyance pipe 41 are so arranged as to meet the aforementioned requirement that the toner deposited on the internal wall of the toner conveyance pipe 41 around the toner outlet 41*c* can be scraped off efficiently to prevent not only the deposition, stagnation and clogging of the toner near the toner outlet 41*c* but also the break of the toner discharging screw 40.

More particularly, the residual toner scraped off from the surface of the photosensitive drum 11 by the cleaning blade 34 is received in the recovered toner receiving groove 38, moved forward through the toner conveyance pipe 41 by the discharging screw 40 to the toner outlet 41*c*, where the used toner is efficiently scraped off by the impeller 40*a*, which is formed conforming to the specified requirements, to drop into the recovered toner container 32 of the toner cartridge 30.

In FIGS. 6 and 7, the numeral 42 denotes a operating lever to be used for changing the position of the toner conveyance pipe 41 between the working position (position where the pipe is connected) and the shunting position (position where the pipe is disconnected) when replacing the toner cartridge.

Said operating lever 42 is pivotally supported with a shaft 421 located at the place where the frame of the process cartridge 10 is fixed, and when the operating lever 42 is raised up to the shunting position (position where the pipe is disconnected), a pin 422 located at the middle of said lever 42 is comes under a frame member 423 fixed to the outer circumference of the toner conveyance pipe 41 to cause the frontward portion 41*b* of the toner conveyance pipe 41 to be turned counterclockwise (upward).

The operating lever 42 can be kept raised by the force of a coil spring 424 installed between said lever 42 and the frame member 423.

On the other hand, a shutter 43 is slidably installed on the outer circumference near the frontward portion 41*b* of the toner conveyance pipe 41. Said shutter 43 is interlocked with the operating lever 42 so that the toner outlet 41*c* located in the bottom of the frontward portion 41*b* of the toner conveyance pipe 41 can be opened or closed according to the rising or falling motion of the operating lever 42.

Thus, the shutter 43 is interlocked with the operating lever 42 through a link member 44 pivotally supported with a pin 425 located at the middle of the operating lever 42.

Thus, when the toner conveyance pipe 41 turned upward by raising the operating lever 42, the toner outlet 41*c* on the side of the toner conveyance pipe 41 will be closed, and the toner outlet 41*c* will be opened when the operating lever 42 is thrown downward as illustrated in FIG. 6. The members 40 through 44 constitute the toner conveyance pipe means in this embodiment of the present invention.

In the case of the above embodiment, the toner cartridge 30 with the feed opening 312 fully opened by peeling off the flexible sealing member 314 in advance and kept facing upward is loaded in the loading device 271 located at the upper part of the toner storage room 31, and the toner cartridge 30 is turned by about 180° to bring the feed opening 312 to face downward and to cause the toner in the feed toner storage room 31 to drop into the storage room 27 due to the gravity for replenishment with the new toner.

When the toner cartridge 30 is turned by about 180°, the recovery opening 323 on the side of the recovered toner container 32 is brought to face upward so that the recovered toner can be received.

After the toner cartridge 30 is loaded, the shutter 324 to cover the recovery opening 323 of the recovered toner container 32 is kept open, and the toner conveyance pipe members 40 through 44 are set to operating positions as illustrated in FIG. 6.

Thus, the new toner dropped into the storage room 27 is gradually conveyed into the toner feed room 24 by the ladder chain 28 and supplied in the appropriate quantity into the developing agent by the feed roller driven by the signal from the sensor 23.

On the other hand, the toner remaining on the photosensitive drum 11 after the toner image is transferred will be scraped off by the cleaning blade 34 and collected into the toner receiving groove 38 passing the toner guide plate 39.

The scraped toner collected in the toner receiving groove 38 will be guided by rotary motion of the toner discharging screw 40 to the toner outlet 41*c* located at the bottom of the frontward portion of the toner conveyance pipe 41 passing through the toner conveyance pipe 41 and to the recovery opening 323 of the toner cartridge 30 and dropped into the recovered toner container 32.

When the recovered toner container 32 is filled up, the container should be replaced with a new toner cartridge by raising the operating lever 42.

More specifically, when the operating lever 42 is raised up, the toner conveyance pipe 41 is caused to turn upward around the base end 41*a* of said pipe to permit the front portion 41*b* of the toner conveyance pipe 41 to be disconnected from the recovery opening of the recovered toner container 32.

In the above case, the raising of the operating lever 42 causes the shutter 43 to slide on the toner conveyance pipe 41 to close the toner outlet 41c of the toner conveyance pipe 41, so that the toner can be prevented from spilling from the toner outlet 41c even when the scraped toner is conveyed continuously through the toner conveyance pipe 41.

Thus, under the above-described condition, the recovery opening 323 of the recovered toner container 32 is covered with the shutter 324; the toner cartridge 30 is turned by about 180° to bring the feed opening 312 to face upward; then, for example, after covering the feed opening 312 with the flexible sealing member 314, the toner cartridge 30 is removed from the loading device 271 located on the toner storage room 27 to be replaced with a new toner cartridge 30.

Explained in the foregoing are the embodiments illustrated in the accompanying drawings, it must be added here that the content of the present invention shall not be confined within the above-discussed embodiments and shall take the forms of other variation as far as such variations remain within the scope of the gist of the present invention.

As discussed in the foregoing, the present invention is characterized by comprising the toner conveyance pipe with the base end communicating with and connected oscillateably to the cleaning device, the interlocking member linked to about the middle of the longitudinal span of said toner conveyance pipe to enable said toner conveyance pipe to oscillate between its set position and shunting position, and the shutter linked to said interlocking member in order to close the outlet at the front end of the toner conveyance pipe when said toner conveyance pipe is at its shunting position and to open said outlet when said toner conveyance pipe is displaced to its setting position, so that when the toner conveyance pipe is displaced to the disconnecting position for replacing the recovered toner container, the shutter is kept closed to prevent the toner from spilling outside, and when the outlet at the front end of the toner conveyance pipe is connected to the recovered toner container, the shutter will be opened automatically, and, because of these characteristics, the present invention is able to provide a toner recovery device assuring excellent performance with simple construction and at low cost.

The present invention is characterized by the toner conveyance pipe to convey the toner from the toner collecting part in the cleaning device to the recovered toner container located near the toner feed device, a screw member to rotate in the pipe member constituting said toner conveyance pipe, the toner-discharging impeller member installed at the front end of said screw member so as to be able to rotate together with the screw member and that the relationship among the turning radius R of said impeller member, the radius r of the screw member and the inside diameter D of the pipe member is $$r \leqq R < D/2,$$

so that the toner deposited on the internal wall of the toner conveyance pipe near the toner outlet can be scraped off efficiently to prevent for sure the deposition of the toner on the toner outlet, the clogging by the toner and the break of the screw. Thus, said characteristics of the present invention is not only able to improve the conveyance efficiency of the screw member of the conveyance pipe but also able to improve the efficiency in packing the toner into the recovered toner container.

The present invention provides a toner conveyance device comprising the toner conveyance pipe with the toner outlet communicating with the recovery opening of the recovered toner container, the screw member installed in said toner conveyance pipe and the impeller member to discharge the toner from said toner outlet, which is characterized by that the length of said impeller member is made longer than the length of the opening of said toner discharging outlet, so that the impeller member will not interfere with the discharging outlet as the screw member rotates to prevent the unsmooth rotation of the screw member and the break of the screw member, which helps not only to provide higher toner conveyance efficiency but also improves the efficiency in packing the recovered toner into the recovered toner container as the excellent effects of the present invention.

What is claimed is:

1. A toner recovery device for collecting toner from a cleaning device to a recovery toner container, comprising a toner conveyance means for conveying toner from said cleaning device to said recovery toner container, said toner conveyance means having a conveyance pipe whose base end portion is rotatably connected to said cleaning device and tip end portion with an outlet opening is detachably coupled to an inlet opening of said recovery toner container so that said tip end portion is pivotted around said base end portion so as to take the coupled position and the detached position;

an operating lever means linked to said conveying pipe for pivotting said tip end portion between the coupled position and the detached position;

a shutter means adapted to move on said conveying pipe interlockingly with the movement of said operating lever means so that said shutter means closes the outlet opening of said conveying pipe on the detached position and opens the outlet opening on the coupled position.

2. The device of claim 1, wherein said toner conveying means comprises a screw means rotatably installed inside of said conveyance pipe.

3. The device of claim 2, wherein said screw means has a length corresponding to that of said conveyance pipe and at the tip end of said screw means corresponding to the position of the outlet opening of said conveying pipe there is provide a rotatable blade member for discharging the toner from the outlet opening.

4. The device of claim 3, wherein the length of said blade member is made longer than that of the outlet opening.

5. The device of claim 3, wherein the rotation radius R of said blade member is determined to satisfy the following relation;

$$r \leqq R < D/2,$$

where r is the rotation radius of said screw member and D is the inside radius of said conveying pipe.

6. An electrostatic recording device comprising the toner recovery device of claim 1.

* * * * *